US009708809B2

(12) United States Patent
Bennett

(10) Patent No.: US 9,708,809 B2
(45) Date of Patent: Jul. 18, 2017

(54) ANCHOR AND METHOD OF USING THE SAME

(71) Applicant: Case Innovations, Inc., Thessalon, Ontario (CA)

(72) Inventor: Darren Bruce Bennett, Thessalon (CA)

(73) Assignee: Darren Bruce Bennett, Thessalon, Ontario (CA)

( * ) Notice: Subject to any disclaimer, the term of this patent is extended or adjusted under 35 U.S.C. 154(b) by 0 days.

(21) Appl. No.: 14/427,624

(22) PCT Filed: Mar. 14, 2014

(86) PCT No.: PCT/CA2014/000240

§ 371 (c)(1),
(2) Date: Mar. 11, 2015

(87) PCT Pub. No.: WO2014/138909

PCT Pub. Date: Sep. 18, 2014

(65) Prior Publication Data

US 2015/0368894 A1 Dec. 24, 2015

Related U.S. Application Data

(63) Continuation-in-part of application No. 13/815,657, filed on Mar. 14, 2013, now abandoned.

(51) Int. Cl.
*E04B 1/38* (2006.01)
*E06B 7/02* (2006.01)
(Continued)

(52) U.S. Cl.
CPC ..... *E04B 1/383* (2013.01); *B28D 1/02* (2013.01); *E06B 7/02* (2013.01); *E21D 20/025* (2013.01);
(Continued)

(58) Field of Classification Search
CPC ..... E04B 1/383; E21D 21/008; F16B 13/0808
(Continued)

(56) References Cited

U.S. PATENT DOCUMENTS 2,771,746 A 11/1956 Fischer et al.
2,950,602 A * 8/1960 Lang ..... E21D 21/008 405/259.3
(Continued)

FOREIGN PATENT DOCUMENTS

CA 2703627 A1 5/2009
DE 839550 C 5/1952
(Continued)

OTHER PUBLICATIONS

International Search Report from PCT Patent Application No. PCT/CA2014/000240 mailed Jul. 3, 2014, application now published as International Publication No. WO 2014/138909 on Sep. 18, 2014.

*Primary Examiner* — Joshua J Michener
*Assistant Examiner* — Alp Akbasli
(74) *Attorney, Agent, or Firm* — Jacqueline F. Mahoney; McDermott Will & Emery LLP

(57) ABSTRACT

Disclosed is an anchor having a sleeve and a concentric shaft having head at one end with a rectangular plate through with the shaft interposed between the head and the adjacent end of the sleeve. A deformable plate is positioned on the shaft between the head and the sleeve so that movement of the sleeve along the shaft towards the head deforms the plate from a configuration where the plate is substantially confined to an area within the perimeter of the head into a substantially planar configuration where the perimeter of the plate extends at least partially beyond the perimeter of the head. Also disclosed is a method of fixing the anchor in a bore hole with the ends of the plate in an undercut in the bore hole and filling the bore hole with resin while venting air via
(Continued)

a passage extending from adjacent to a closed end of the bore hole through a suitable cover.

22 Claims, 6 Drawing Sheets

(51) Int. Cl.
*B28D 1/02* (2006.01)
*E21D 20/02* (2006.01)
*E21D 21/00* (2006.01)

(52) U.S. Cl.
CPC ..... *E21D 21/008* (2013.01); *Y10T 408/60* (2015.01); *Y10T 408/89* (2015.01)

(58) Field of Classification Search
USPC ..... 405/259.1, 259.4, 259.5; 411/82, 82.1
See application file for complete search history.

(56) References Cited

U.S. PATENT DOCUMENTS 3,364,808 A 2/1966 Fischer et al.
3,968,721 A * 7/1976 Fischer ..... F16B 13/066 411/18
4,112,813 A * 9/1978 Kuhlmann ..... F16B 13/045 411/49
4,147,458 A * 4/1979 Elders ..... F16B 13/0875 405/259.1
4,192,631 A * 3/1980 Vass ..... E21D 21/0026 405/259.1
4,287,807 A * 9/1981 Pacharis ..... F16B 13/065 411/42
4,305,687 A * 12/1981 Parker ..... E21D 21/0046 405/259.3
4,339,217 A 7/1982 Lacey
4,393,638 A 7/1983 Sell et al.
4,413,930 A * 11/1983 Calandra, Jr. ..... E21D 21/008 405/259.3
4,419,805 A * 12/1983 Calandra, Jr. ..... E21D 20/02 29/432
4,518,292 A * 5/1985 Calandra, Jr. ..... E21D 20/02 29/522.1
4,614,471 A * 9/1986 Mauritz ..... F16B 13/128 405/259.3
4,626,139 A * 12/1986 Blackwell ..... F16B 13/0875 405/259.1
4,714,391 A * 12/1987 Bergner ..... B25B 13/48 411/54
4,765,778 A * 8/1988 Valentine ..... E21D 20/028 405/259.5
4,770,580 A 9/1988 Fishcher
4,789,284 A 12/1988 White
4,968,200 A * 11/1990 Mark ..... F16B 13/065 411/55
4,978,258 A * 12/1990 Lins ..... B23B 51/0018 175/292
5,042,961 A * 8/1991 Scott ..... E21D 21/008 405/259.4
5,059,073 A 10/1991 Revol et al.
5,082,399 A * 1/1992 Frease ..... E21D 21/0093 405/259.5
5,184,922 A * 2/1993 Blackwell ..... F16B 13/0875 405/259.1
5,232,311 A * 8/1993 Stankus ..... E21D 21/008 405/259.4
5,244,314 A * 9/1993 Calandra, Jr. ..... E21D 21/008 405/259.4
5,344,257 A * 9/1994 Wright ..... E21D 21/008 405/259.1
5,352,077 A 10/1994 Lind
5,531,535 A 7/1996 Lind et al.
5,593,261 A * 1/1997 Giannuzzi ..... F16B 13/066 411/32
5,666,779 A * 9/1997 Fuchs ..... F16B 13/0833 411/82
5,885,031 A * 3/1999 White ..... E21D 21/008 405/259.1
5,921,733 A 7/1999 Kaibach et al.
6,742,966 B2 * 6/2004 Cook ..... E21D 21/008 405/259.3
6,851,942 B2 2/2005 Wohlrab
6,986,623 B2 * 1/2006 Robertson, Jr. ..... E21D 21/008 405/259.4
7,179,020 B2 * 2/2007 Robertson, Jr. ..... E21D 21/008 405/259.4
7,959,379 B2 * 6/2011 Robertson, Jr. ..... E21D 21/008 405/259.1
8,151,541 B2 * 4/2012 Aeschlimann ..... B29C 65/645 405/259.5
8,631,629 B1 * 1/2014 Wiener ..... F16B 5/0275 126/623
2004/0136788 A1 * 7/2004 Hindle ..... E21D 21/0026 405/259.1
2007/0031196 A1 * 2/2007 Bruneau ..... E21D 21/0026 405/259.4
2008/0310930 A1 12/2008 Schaeffer et al.
2011/0062617 A1 3/2011 Lehmann et al.
2012/0192404 A1 8/2012 Rosenkranz et al.
2012/0213607 A1 * 8/2012 Peled ..... F16B 13/0866 411/24
2012/0251262 A1 10/2012 Salgado
2013/0236251 A1 * 9/2013 Smith ..... E21D 20/026 405/259.5
2014/0037388 A1 * 2/2014 Ahola ..... E21D 20/02 405/259.3
2014/0270983 A1 9/2014 Bennett

FOREIGN PATENT DOCUMENTS

EP 0029354 A1 5/1981
GB 2004966 A 4/1979
WO WO 96/15334 5/1996

* cited by examiner

ANCHOR AND METHOD OF USING THE SAME

CROSS-REFERENCE TO RELATED APPLICATIONS

This application is a U.S. National Stage of International Patent Application No. PCT/CA2014/000240, filed Mar. 14, 2014, which is a continuation-in-part of U.S. application Ser. No. 13/815,657 filed Mar. 14, 2013, now pending, each of which is hereby incorporated by reference in its entirety.

FIELD OF THE INVENTION

The present invention generally relates to hardware. More specifically, the invention relates to an anchor particularly suited as an anchor for concrete and to a kit and methods making use of the same.

BACKGROUND OF THE INVENTION

Many different anchors and anchoring systems have been proposed, some of which are particularly suited to providing an anchor that may be embedded in concrete and to which other structure(s) may be attached. See, for example, EPC application published as No. 0029354 on May 27, 1981: Canadian patent application No. 2,703,627 published May 14, 2009, and U.S. Pat. Nos. 2,771,746; 4,339,217; 4,393,638; 4,770,580; 4,789,284; 4,968,200; 5,531,535; 5,352,077; 5,921,733; and 6,851,492; and U.S. Patent Publications: 2008/0310930; 2011/0062617; and 2012/0192404.

The common theme in these anchoring systems is to provide some form of undercut in the bore hole in which the anchor is to be secured and expand a part of the anchor to substantially fill the undercut area. In some cases, the anchor itself is provided with some form of cutter that forms the undercut. In others, the expanding part of the anchor is simply forced into the surrounding medium, so the anchor itself substantially fills and/or blocks off the entrance to the undercut area so as to stop flow of material past the expanded portion.

SUMMARY OF THE INVENTION

According to an aspect of the present invention, there is provided an anchor for embedding into a substrate. The anchor having a shaft; a head adjacent to one end of the shaft and extending laterally from the shaft; a sleeve axially surrounding the shaft; an adjustable clamp juxtaposed to the sleeve for moving the sleeve along the longitudinal axis of the shaft; and a deformable plate positioned on the shaft between the head and the sleeve so that movement of the sleeve along the shaft towards the head deforms the plate from a configuration where the plate is substantially confined to an area within the perimeter of the head into a substantially planar configuration where the perimeter of the plate extends at least partially beyond the perimeter of the head.

In one embodiment, the shaft is at least partially threaded and the clamp is a bolt.

In another embodiment, the deformable plate is rectangular having a major and minor axis, the said plate having a substantially V-shape, the apex of which being substantially parallel to the minor axis, and the plate having a central hole through which the shaft passes, where movement of the sleeve along said shaft towards the head deforms said V-shape into a substantially planar configuration with the ends of the plate on the major axis extending laterally beyond the perimeter of the head. In one configuration, the apex is adjacent to the sleeve.

In a further embodiment, the anchor also has a cover having a central passage for receiving the shaft. The cover can have an inlet for receiving a resin and/or an outlet for venting gas. When present, the outlet can be associated with a venting tube extending away from the cover and substantially parallel to the longitudinal axis of the shaft. Alternatively, a groove can be positioned along the longitudinal surface of the shaft extending from one end of the shaft to a position adjacent the other end of the shaft.

According to another aspect of the present invention, there is provided a kit for embedding an anchor into a substrate. The kit having an anchor as described above; a cutting tool having a shaft and one or more cutter disks adjacent to one end of the shaft and extending laterally from the shaft; and a set of instructions for use.

In one embodiment, the kit also has a container of resin, preferably an epoxy resin.

In another embodiment, the kit also has a second drill bit for generating a bore hole in the substrate. For example, a masonry drill bit.

In a further embodiment, the kit also has a cover having a central passage for receiving the shaft of the anchor and a locking mechanism for securing the cover to the shaft of the anchor.

According to another aspect of the present invention, there is provided a method for installing the anchor as defined above in a substrate. The method involving: drilling a bore hole in the substrate; cutting an undercut in the bore hole between an open end and a closed end of the bore hole; inserting the anchor into the bore hole and moving the sleeve along the shaft towards the head to deform the plate into a substantially planar position that occupies a portion of the undercut; and filling the bore hole and undercut with a resin.

According to further aspect of the present invention, there is provided a method for installing the anchor as defined above in a substrate having a bore hole. The method involving: cutting an undercut in the bore hole between an open end and a closed end of the bore hole; inserting the anchor into the bore hole and moving the sleeve along the shaft towards the head to deform the plate into a substantially planar position that occupies a portion of the undercut; and filling the bore hole and undercut with a resin.

In one embodiment, prior to filling the bore hole and undercut with resin, a cover having a central passage for receiving the shaft is positioned over the shaft to cover the open end of the bore hole and secured into place. Preferably, the bore hole is filled with resin through an inlet in the cover.

BRIEF DESCRIPTION OF THE DRAWINGS

These and other features, aspects and advantages of the present invention will become better understood with regard to the following description and accompanying drawings wherein.

DESCRIPTION OF THE INVENTION

Figure 1:
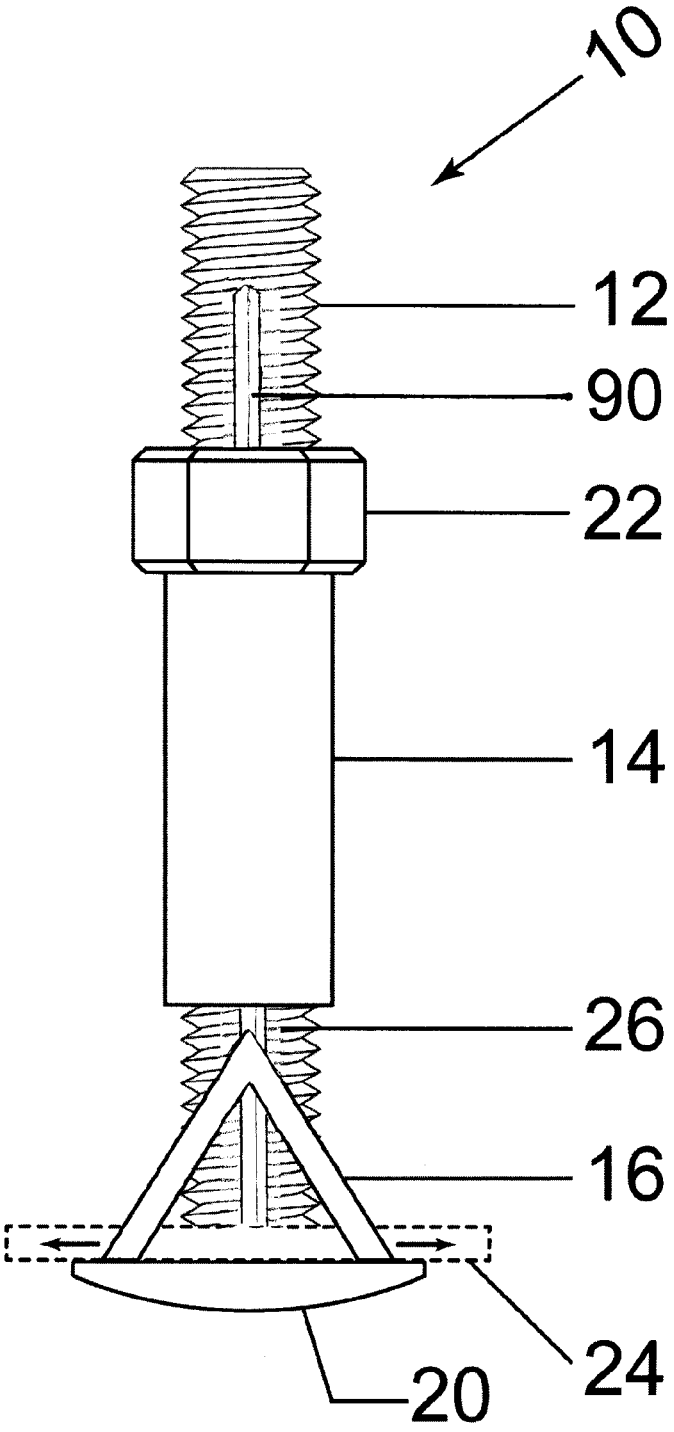
FIG. 1 is a side elevation of an anchor according to an embodiment of the present invention.

As shown in FIG. 1 the anchor 10 of the present invention is composed of three main parts, namely: a main shaft 12, which normally will be a threaded shaft; a sleeve 14 telescoped over and concentric with the shaft 12; and, a deformable plate 16 positioned on the shaft between a head 20 and the sleeve 14. In most cases, the deformable plate 16 will have a central passage 18 to accommodate the shaft 12 (see FIG. 2).

An adjustable clamp or pressure applicator 22 is juxtaposed to the sleeve 14 for moving the sleeve 14 along the longitudinal axis of the shaft 12. In this case, an adjustable clamp 22 can be any physical element that: can move along the longitudinal axis of the shaft 12; can apply enough pressure to the sleeve 14 to cause deformation of the plate 16; and, can be locked into place along the shaft 12 to prevent movement of the sleeve 14. When the shaft 12 is threaded, the adjustable clamp will, in most cases, be a correspondingly dimensioned nut. However, it is also possible that the sleeve 14 or at least a portion thereof can act as the adjustable clamp 22 by being able to satisfy the criteria described above. For example, a coupling nut could be used as the sleeve 14 and the adjustable clamp 22.

For the purposes of the present discussion, the adjustable clamp 22 is in the form of a nut. However, as mentioned above, other clamps are contemplated and thus the description provided herein should not be limited to only nuts. In operation, the nut 22 is turned clockwise or counter-clockwise with respect to longitudinal axis of the shaft 12. When moved towards the head 20 of the anchor 10, the nut 22 applies pressure to the sleeve 14 causing it to move along the longitudinal axis of the shaft 12, which in turn distorts the deformable plate 16.

Figure 2:
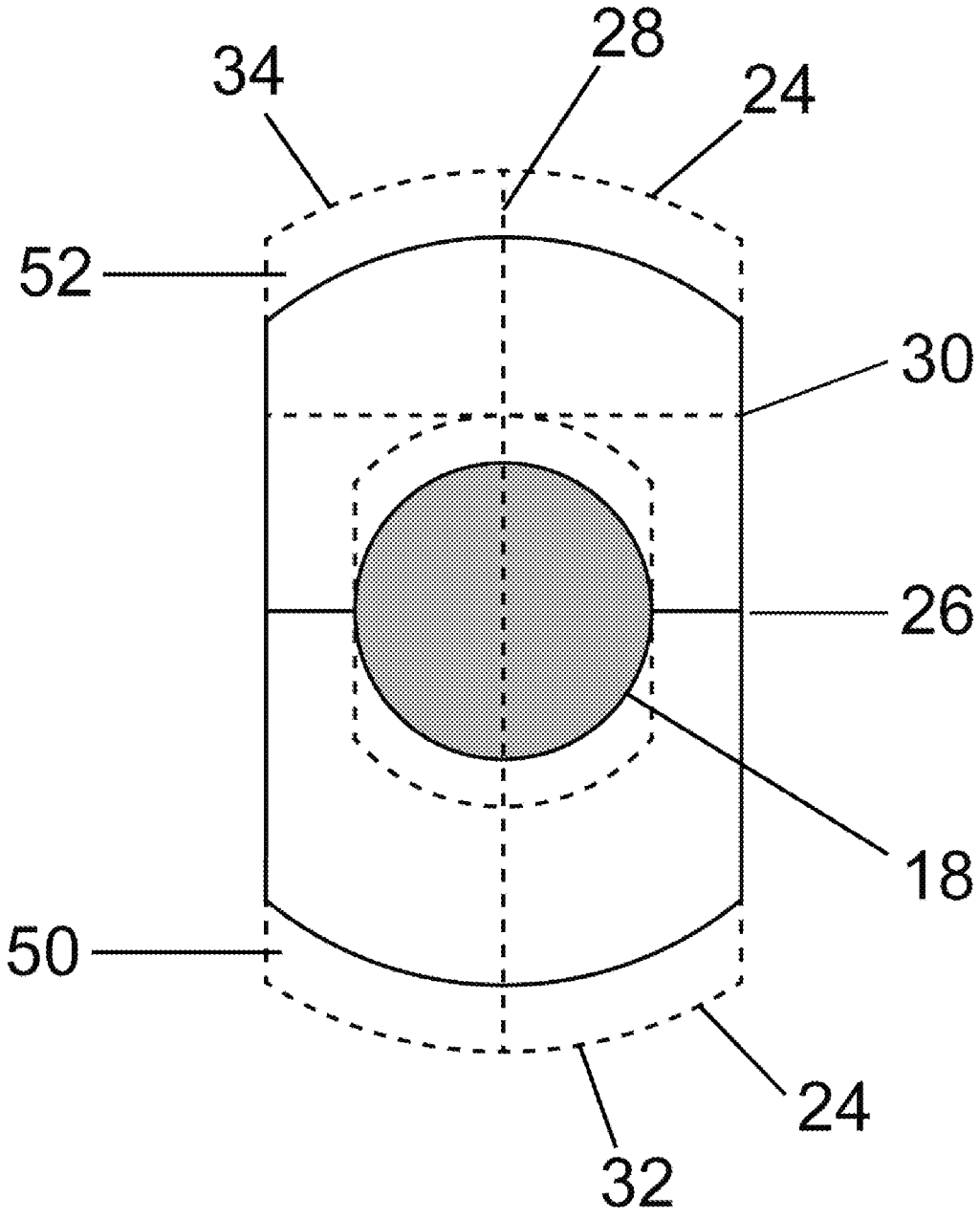
FIG. 2 is a plan view of the anchor plate for holding the anchor in position in a bore hole with the plate expanded shown by dash lines.

In its initial condition (before distortion into the expanded position shown in dash lines 24 in FIGS. 1 and 2) the plate 16 is substantially confined to an area within the perimeter of the head 20. This allows the anchor 10 to be easily inserted into the bore hole 40. The shape of the plate 16 is typically rectangular, however, any shape that allows for distortion of the plate 16 from a configuration where the plate 16 is substantially confined to an area within the perimeter of the head 20 to a configuration where the plate 16 is substantially planar and the perimeter of the plate extends at least partially beyond the perimeter of the head 20 will work. In one embodiment, the plate 16 is V-shaped with the apex 26 of the V-shape, which acts as a hinge, is positioned adjacent to the sleeve 14, as shown, but it may be inverted if desired. The plate 16 has a major axis (longitudinal axis) as indicated at 28 and a mutually perpendicular minor axis 30. The major axis 28 in effect depicts the longer length of the plate 16 after deformation of the plate 16 into its expanded condition as indicated by the dash lines at 24 of FIGS. 1 and 2. The apex 26 extends parallel to the minor axis 30 and is centrally positioned mid way between the axial ends 32 and 34 of the plate 16. In another embodiment, the deformable plate 16 is U-shaped having three sections with the intersections between the center section and the two end pieces acting like hinges.

Figure 3:
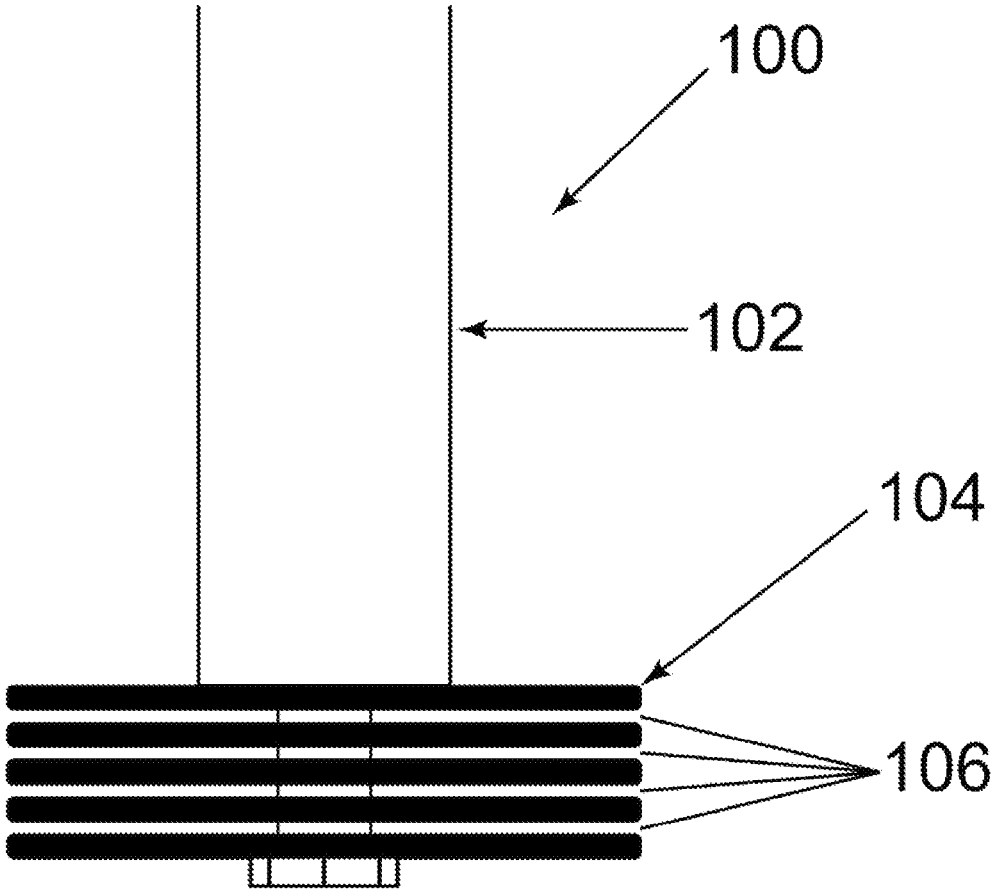
FIG. 3 is a side elevation of an embodiment of the cutter used to cut the undercut in the bore hole in which the anchor is to be mounted.
Figure 4:
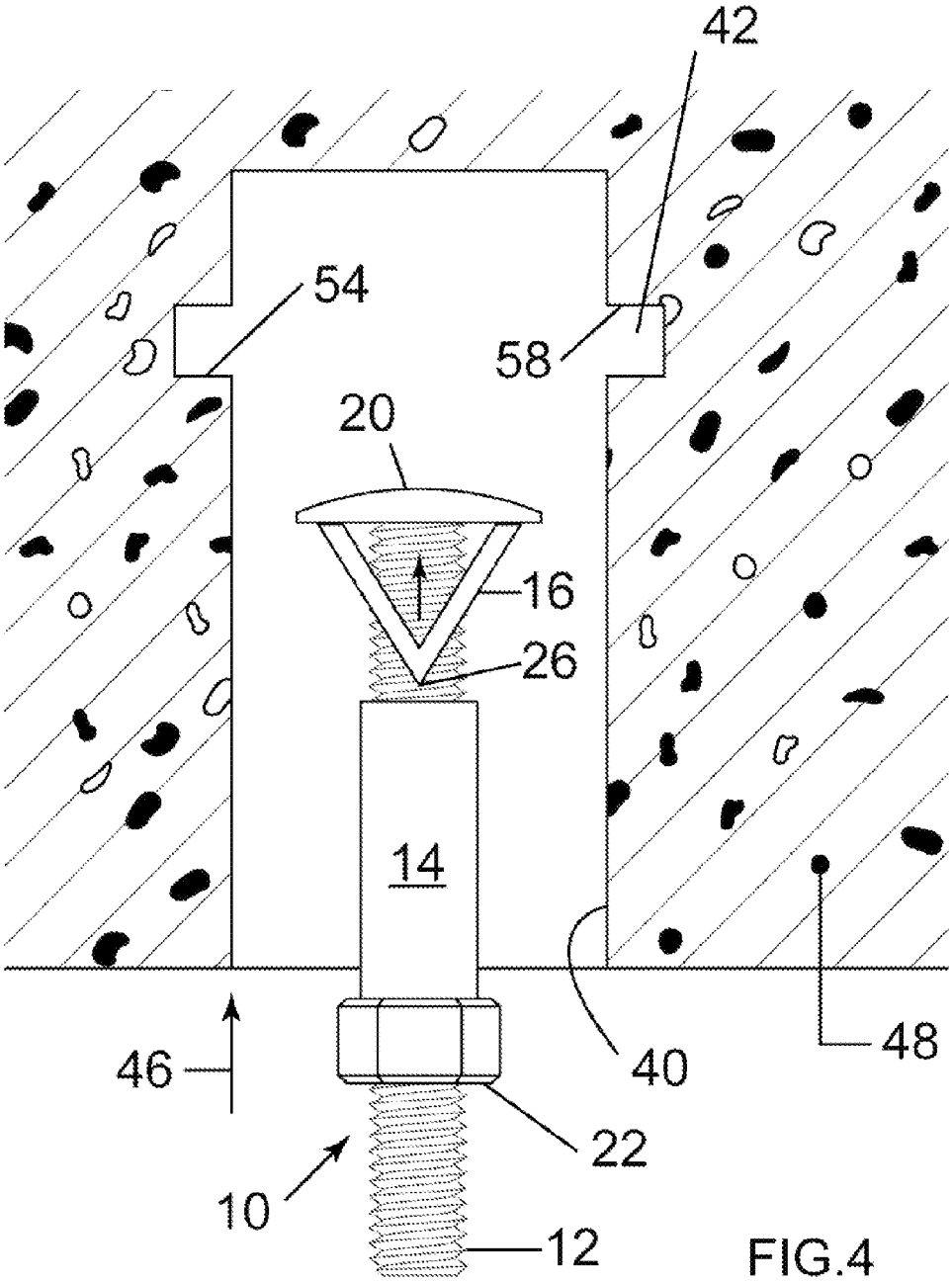
FIG. 4 is a view showing a cross section of a bore hole and an anchor inserted therein according to an embodiment of the present.
Figure 5:
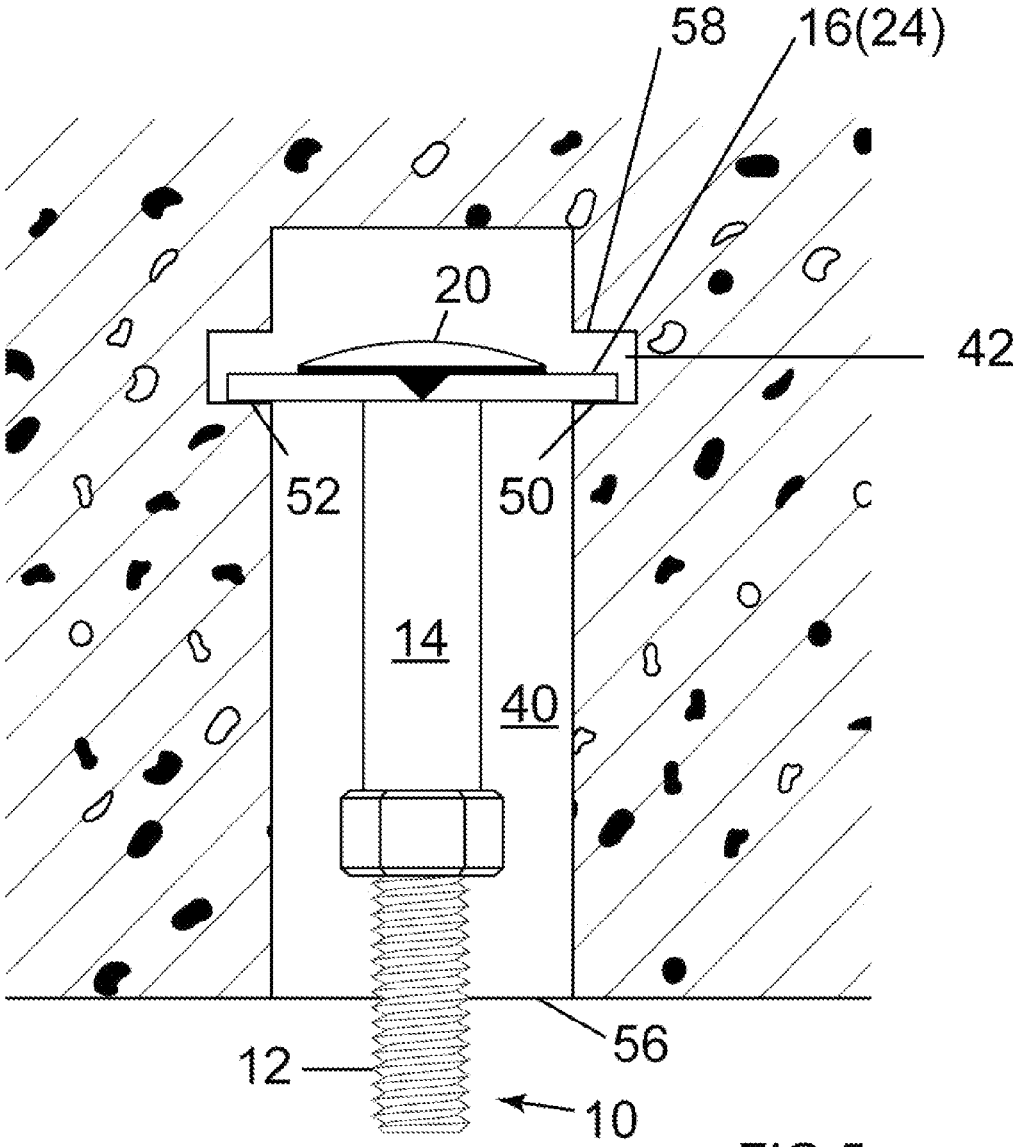
FIG. 5 is a view similar to FIG. 4 but with the anchor in position with the plate expanded into the undercut.
Figure 6:
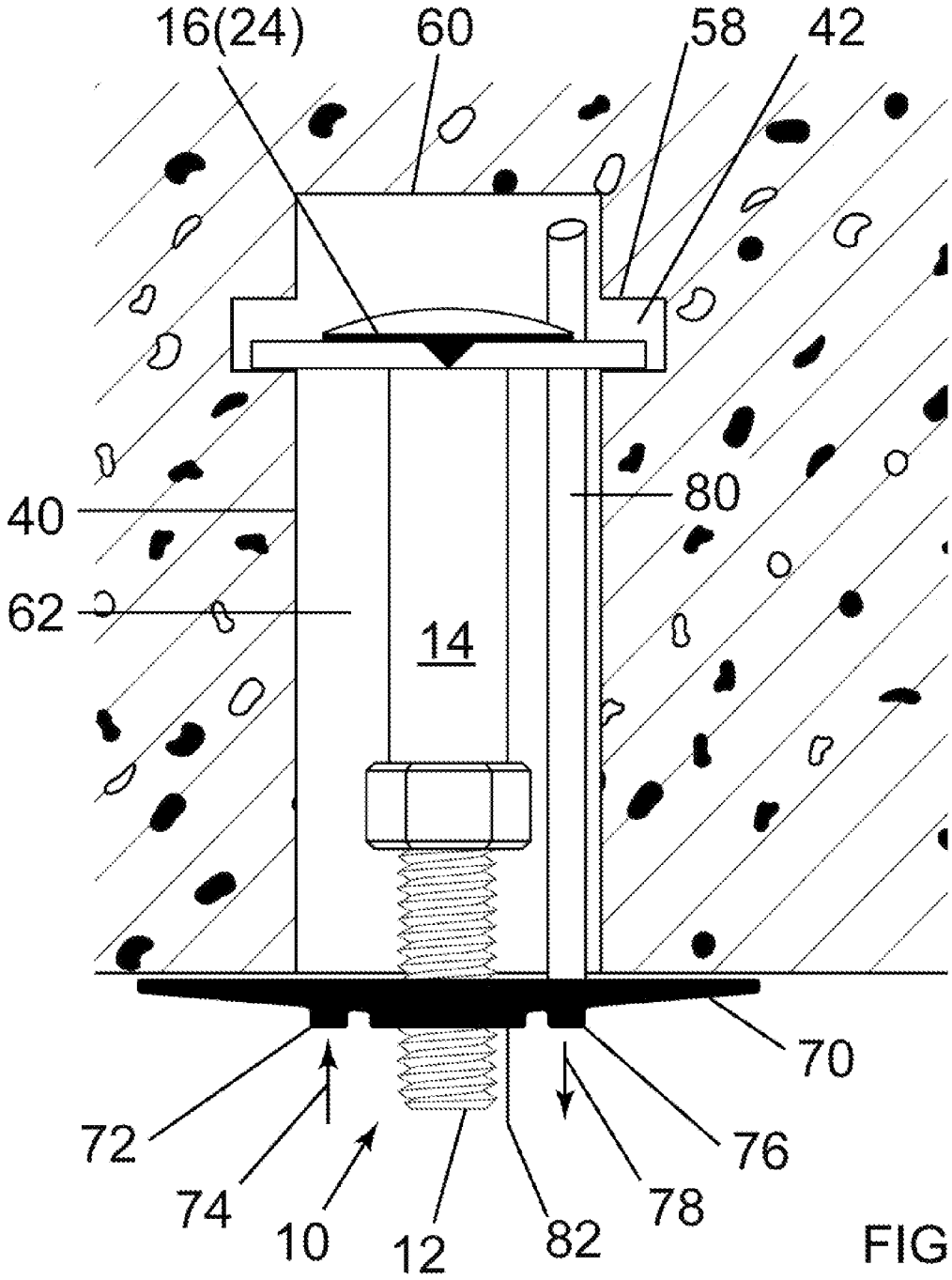
FIG. 6 is a view similar to FIG. 5 but with the bore hole filled with resin and showing the vent pipe in position to permit air to be driven from the bore hole as it is being filled with resin when the bore hole is in an inverted position.

Turning to FIG. 3, a cutting tool 100 is used to produce the undercut 42 in the bore hole 40 in which the anchor 10 is to be mounted (see FIGS. 4, 5 and 6). The cutting tool 100 is formed by a shaft 102 having a plurality of equally spaced cutter disks 104 mounted concentrically thereon and projecting radially therefrom. The peripheries of the cutting disks 104 will preferably be formed with abrasive or cutting teeth suitable to cut the substrate 48 in which the undercut 42 is to be formed. Preferably the cutter disks will have a thickness td (measured axially of the shaft 102) of less than 3/32 inches and preferably between 1/8 and 3/16 inches and the spacing between adjacent disks 104 as indicated at 106 will have a thickness is (measured axially of the shaft 102) of more than 1/8 inches and preferably between 1/8 and 1/4 inches.

In operation, the circumference of the cutting disks 104 will be less than the circumference of the bore hole 40 to allow the cutting tool 100 to be easily inserted into the bottom of the bore hole 40. Once inserted, the shaft 102 of the cutting tool 100 travels along the circumference of the bore hole 40 to form the undercut 42.

As shown in FIG. 4, the anchor 10 is inserted in the bore hole 40, as indicated by the arrow 46, formed in the substrate 48. In most cases, the substrate 48 is concrete. However, it is possible that the substrate 48 could be any other building material, such as wood or stone. After the anchor 10 has been positioned in the bore hole 40 with the plate 16 at the level of the undercut 42, the adjustable clamp 22 is moved along the shaft 12 to force the sleeve against the plate 16, which generates a distorting pressure against the plate 16 between the sleeve 14 and the head 20. The distorting pressure causes the plate 16 to form a substantially planar configuration where the extended ends 50 and 52 are positioned in the undercut 42 (see FIG. 5).

In the inverted application shown in FIGS. 4, 5 and 6, the ends 50 and 52 of the plate 16 are automatically (by gravity) positioned against the wall 54 of the undercut 42 adjacent to, but spaced from, the open end 56 of the bore hole 40. In an upright or horizontal bore hole other means are used to hold the plate edges 50 and 52 against the wall 54 adjacent to the open end 56. Preferably the wall 58 of the undercut 42 opposite the wall 54 will be spaced from the closed end 60 of the bore hole 40 to accommodate the head 20 of the shaft 12.

In one embodiment, after the anchor 10 has been positioned as described above, the bore hole 40, including the undercut 42, is filled with a suitable resin as indicated at 62 (see FIG. 6). For example, an epoxy resin, or any other resin that may be set in situ, can be used to fill the bore hole 40 and surround the anchor 10 completely or partially, thus more securely locking the anchor 10 in position.

When the bore hole 40 extends down into a substrate 48 i.e. when the hole 40 is in an upright position or in the same direction as the force of gravity, such as on a floor, filling the bore hole 40 is a relatively routine procedure that is accomplished by merely filling the borehole 40 with resin. However, when the bore hole 40 is in an opposite position, i.e. in an inverted or horizontal position (in the opposite direction or perpendicular to the force of gravity, respectively), such as on a ceiling or wall, filling the bore hole 40 with resin is more complicated (see FIGS. 4, 5 and 6). As shown in FIG. 6, when filling the inverted bore hole 40 with resin a suitable cap or cover 70 is used to close the open end 56 of the bore hole 40. In most embodiments, the resin is injected through the cover 70 and into the bore hole 40. In this arrangement, the cover 70 is provided with an inlet 72 through which resin is forced into the bore hole 40 as indicated at 74. To allow air to escape the bore hole 40, it is preferred to provide the cover 70 with an outlet 76 for venting air from the bore hole 40. The movement of air through the outlet 76 is shown by the arrow 78. An air venting pipe 80 can be provided, which extends from adjacent to the closed end 60 of the bore hole 40 and connects to the outlet 76 so that air adjacent to the closed end 60 is expelled as the bore hole 40 is filled i.e. air passes from adjacent to the closed end 60 and out past the plate 16 through the outlet 76. In another embodiment, as shown in FIG. 1, the main shaft 12 is provided with a groove 90 positioned on the longitudinal surface of the shaft 12 (i.e. the threaded surface) that extends from one end of the shaft 12 to a position adjacent the other end of the shaft 12. Preferably, the groove 90 extends from the end of the shaft 12 that is adjacent to the head 20 to a position that is intermediate to the clamp 22 and the other end of the shaft 12. In order to work efficiently, the groove 90 should terminate at a position that is intermediate the clamp 22 and the opposite end of the shaft 12 from the end adjacent the head, when the clamp 22 is at a position causing deformation of the plate 16. This arrangement allows air to escape from the cavity near the closed end 60 of the bore hole 40 out to the environment.

The cover 70 may be held in position via a locking mechanism 82, such as a nut, which engages the shaft 12. The height of the anchor 10 in a non-inverted (upright) bore hole 40 may be adjusted by changing the axial spacing between the plate 16 and the cap 70 using the nut 82.

Thus in practicing the method of the present invention bore hole 40 is first made and then an undercut 42 is produced in the bore hole 40, preferably using the cutting tool 100. The anchor 10 is positioned in the bore hole 40 with the plate 16 at the required level relative to the undercut 42. The plate 16 is then distorted by applying pressure to the sleeve 14 to squeeze the plate 16 between the sleeve 14 and the head 20 and thereby change the configuration of the plate 16 from its initial configuration where the plate 16 is substantially confined to an area within the perimeter of the head into a substantially planar configuration, where the perimeter of the plate 16 extends at least partially beyond the perimeter of the head 20. When the bore hole 40 is inverted, such as in a ceiling application, a cover 70 is then applied over the shaft 12 and held into place by a locking mechanism 82. A cover 70 can also be used when the bore hole 40 is upright. Resin 62 is then injected into the bore hole 40 through the inlet 72 provided in the cover 70, as indicated by the arrow 74, and air ejected from the bore hole 40, as indicated by the arrow 78, thereby filling the bore hole 40 and surrounding the anchor 10 with resin that then sets in situ.

In some cases if the space between the undercut 42 and the closed end 60 is sufficient, the venting of air may not be required and the trapped air simply compressed, provided sufficient resin can be injected to substantially fill the bore hole 40 to about the level of the wall 58. If the bore hole 40 is in upright position, it will be apparent that the tube 80 may be omitted and in many cases the venting outlet for air may be provided by an imperfect seal of the cover 70 to the substrate in which the anchor 10 is being used.

The anchor 10 described herein can be provided as part of a kit. Preferably, the kit will also contain the cutting tool 100 for producing the undercut 42 in the bore hole 40. Replacement cutter disks 104 can also be included in the kit to replace any disk damaged during use. Moreover, a drill bit, such as a masonry bit, may also be included in the kit to produce the bore hole 40.

Depending upon the intended application, i.e. inverted or upright bore hole, the kit can be provided with a cover 70 as described above. In addition, the kit can include a container, such as a tube, of resin to be used in the bore hole 40. A set of instructions for using the anchor and the related components described above, can be included with the kit. Typically the instructions will be written instructions, however, links or codes that can be scanned with a smartphone and linked to a website may be provided in lieu of written instructions.

It will be understood that numerous modifications thereto will appear to those skilled in the art. Accordingly, the above description and accompanying drawings should be taken as illustrative of the invention and not in a limiting sense. It will further be understood that it is intended to cover any variations, uses, or adaptations of the invention following, in general, the principles of the invention and including such departures from the present disclosure as come within known or customary practice within the art to which the invention pertains and as may be applied to the essential features herein set forth, and as follows in the scope of the appended claims.

The invention claimed is:

1. An anchor for embedding into a borehole having an undercut region, the anchor comprising a shaft; a head adjacent to one end of the shaft and extending laterally from the shaft; a sleeve axially surrounding the shaft; an adjustable clamp juxtaposed to the sleeve for moving the sleeve along the longitudinal axis of the shaft; and a deformable plate positioned on the shaft between the head and the sleeve, wherein the deformable plate is capable of movement between a first position wherein the plate is substantially confined to an area within a perimeter of the head and a second position wherein the plate is substantially uniplanar and perpendicular to the shaft and, with a perimeter of the plate extending at least partially beyond a circumference of the borehole and into the undercut region, and wherein movement of the sleeve along the shaft towards the head moves the deformable plate between the first and second positions.

2. The anchor of claim 1, wherein the shaft is at least partially threaded.

3. The anchor of claim 2, wherein the clamp is a nut.

4. The anchor of claim 1, wherein the deformable plate has a substantially V-shape with a central hole through which the shaft passes, wherein movement of the sleeve along said shaft towards the head deforms said V-shape into a substantially uniplanar configuration with the ends of the plate on the longitudinal axis extending laterally beyond the circumference of the borehole and into the undercut region.

5. The anchor of claim 4, wherein an apex of the substantially V-shape is adjacent to the sleeve.

6. The anchor of claim 1, further comprising a cover having a central passage for receiving the shaft.

7. The anchor of claim 6, wherein the cover further comprises an inlet for receiving a resin or an outlet for venting gas or a combination of both.

8. The anchor of claim 1, further comprising a groove positioned along the longitudinal surface of the shaft.

9. A kit for embedding an anchor into a substrate, the kit comprising:

a cutting tool for developing an undercut region in a borehole, the cutting tool comprising a shaft; and one or more cutter disks adjacent to one end of the shaft and extending laterally from the shaft;

an anchor comprising a shaft; a head adjacent to one end of the shaft and extending laterally from the shaft; a sleeve axially surrounding the shaft; an adjustable clamp juxtaposed to the sleeve for moving the sleeve along the longitudinal axis of the shaft; and a deformable plate positioned on the shaft between the head and the sleeve, wherein the deformable plate is capable of movement between a first position wherein the plate is substantially confined to an area within the perimeter of the head and a second position wherein the plate is perpendicular to the shaft and substantially uniplanar with the perimeter of the plate extending at least partially beyond the circumference of the borehole and into the undercut region, and wherein movement of the sleeve along the shaft towards the head moves the deformable plate between the first and second positions; and a set of instructions for use.

10. The kit of claim 9, further comprising a container of resin, wherein the resin is an epoxy resin.

11. The kit of claim 9, further comprising a second drill bit for generating a bore hole in the substrate, wherein the second drill bit is a masonry drill bit.

12. The kit of claim 9, further comprising a cover having a central passage for receiving the shaft of the anchor and a locking mechanism for securing the cover to the shaft of the anchor.

13. The kit of claim 9, wherein the shaft of the anchor is at least partially threaded.

14. The kit of claim 9, wherein the clamp is a bolt.

15. The kit of claim 9, wherein the deformable plate has a substantially V-shape with a central hole through which the shaft passes, wherein movement of the sleeve along said shaft towards the head deforms said V-shape into a substantially uniplanar configuration with the ends of the plate on the longitudinal axis extending laterally beyond the circumference of the borehole and into the undercut region.

16. The kit of claim 15, wherein the apex is adjacent to the sleeve.

17. The kit of claim 12, wherein the cover further comprises an inlet for receiving a resin, or an outlet for venting gas or a combination of both.

18. A method for installing the anchor as defined in claim 1 in a substrate having a bore hole, the method comprising the steps of:

cutting an undercut in the bore hole between an open end and a closed end of the bore hole;

inserting the anchor into the bore hole and moving the sleeve along the shaft towards the head to deform the plate into a substantially planar position that occupies a portion of the undercut; and filling the bore hole and undercut with a resin.

19. The method of claim 18, wherein prior to filling the bore hole and undercut with resin, a cover having a central passage for receiving the shaft is positioned over the shaft to cover the open end of the bore hole and secured into place.

20. The method of claim 19, wherein the bore hole is filled with resin through an inlet in the cover.

21. The anchor of claim 7, wherein the outlet is connected to a venting tube extending away from the cover and substantially parallel to the longitudinal axis of the shaft.

22. The method of claim 17, wherein the outlet is connected to a venting tube extending away from the cover and substantially parallel to the longitudinal axis of the shaft.

* * * * *